US010119765B2

(12) United States Patent
Shao et al.

(10) Patent No.: US 10,119,765 B2
(45) Date of Patent: Nov. 6, 2018

(54) ARC-SHAPED PLATE HEAT EXCHANGER

(71) Applicant: LUOYANG RUICHANG ENVIRONMENTAL ENGINEERING CO., LTD., Luoyang, Henan (CN)

(72) Inventors: Song Shao, Luoyang (CN); Feng Lv, Luoyang (CN); Juyuan Tang, Luoyang (CN); Guohui Shao, Luoyang (CN)

(73) Assignee: LUOYANG RUICHANG ENVIRONMENTAL ENGINEERING CO., LTD., Luoyang (CN)

( * ) Notice: Subject to any disclaimer, the term of this patent is extended or adjusted under 35 U.S.C. 154(b) by 0 days.

(21) Appl. No.: 15/535,800

(22) PCT Filed: Jan. 27, 2016

(86) PCT No.: PCT/CN2016/072298
§ 371 (c)(1),
(2) Date: Jun. 14, 2017

(87) PCT Pub. No.: WO2016/095872
PCT Pub. Date: Jun. 23, 2016

(65) Prior Publication Data

US 2017/0328645 A1 Nov. 16, 2017

(51) Int. Cl.
*F28D 7/00* (2006.01)
*F28D 9/00* (2006.01)
(Continued)

(52) U.S. Cl.
CPC ..... *F28D 9/0012* (2013.01); *F28D 9/0006* (2013.01); *F28F 9/22* (2013.01);
(Continued)

(58) Field of Classification Search
CPC ..... F28D 7/103; F28D 7/1615; F28D 7/1679; F28D 9/0012; F28D 9/0006;
(Continued)

(56) References Cited

U.S. PATENT DOCUMENTS 3,412,787 A * 11/1968 Muligan ..... F28D 9/04 165/150
4,089,370 A 5/1978 Marchal
(Continued)

FOREIGN PATENT DOCUMENTS

CN 201444007 U 4/2010
CN 201548105 U 8/2010
(Continued)

OTHER PUBLICATIONS

Jan. 26, 2016 Office Action issued in Chinese Patent Application No. 201410768584.7.
(Continued)

*Primary Examiner* — Travis Ruby
(74) *Attorney, Agent, or Firm* — Oliff PLC

(57) ABSTRACT

An arc-shaped plate heat exchanger, including a cylindrical housing and a heat-exchanging plate assembly. The heat-exchanging plate assembly includes two groups of arc-shaped heat-exchanging plates symmetrically disposed at either side of the axis of the housing. In each group of the arc-shaped heat-exchanging plate, multiple arc-shaped heat-exchanging plates are arranged from the housing center outward and form isolating first and second fluid channels, the plates' diameters increasing outward. During heat exchange, cold fluid enters the heat exchanger from the housing's first fluid inlet, and flows through straight channels of the arc-shaped heat-exchanging plates to exit from a first fluid outlet, while the hot fluid enters the heat exchanger from a second fluid entrance on the side wall of the housing, and flows through arc-shaped channels of the arc-shaped heat-exchanging plates to exit from a second fluid outlet. Heat exchange between the cold and hot fluid is thus achieved.

12 Claims, 10 Drawing Sheets

(51) Int. Cl.
*F28F 27/02* (2006.01)
*F28F 9/22* (2006.01)

(52) U.S. Cl.
CPC ..... *F28F 27/02* (2013.01); *F28F 2009/224* (2013.01); *F28F 2225/04* (2013.01); *F28F 2230/00* (2013.01)

(58) Field of Classification Search
CPC .. F28D 9/0068; F28D 9/04; F28F 9/22; F28F 27/02; F28F 2009/224; F28F 2009/226; F28F 2210/10; F28F 2225/04; F28F 2230/00; F28F 2240/00
See application file for complete search history.

(56) References Cited

U.S. PATENT DOCUMENTS

| | | | | |
|---|---|---|---|---|
| 4,215,745 | A * | 8/1980 | Tuckmantel | F28F 9/005 165/160 |
| 4,438,809 | A | 3/1984 | Papis | |
| 4,470,455 | A | 9/1984 | Sacca | |
| 4,532,775 | A | 8/1985 | Hofmann | |
| 6,585,034 | B2 * | 7/2003 | Oswald | F23L 15/04 165/10 |
| 2005/0109493 | A1 * | 5/2005 | Wu | F02B 29/0462 165/157 |
| 2007/0170660 | A1 * | 7/2007 | Burgess | F28F 9/0219 277/596 |
| 2017/0115072 | A1 * | 4/2017 | Machalek | F28F 9/22 |

FOREIGN PATENT DOCUMENTS

| | | | |
|---|---|---|---|
| CN | 202018225 | U | 10/2011 |
| CN | 203810987 | U | 9/2014 |
| CN | 104457343 | A | 3/2015 |
| CN | 104501632 | A | 4/2015 |
| CN | 204478885 | U | 7/2015 |
| CN | 204478886 | U | 7/2015 |
| WO | 01/67018 | A1 | 9/2001 |

OTHER PUBLICATIONS

May 4, 2016 Written Opinion of International Searching Authority issued in International Patent Application No. PCT/CN2016/072298.
May 4, 2016 International Search Report issued in International Application No. PCT/CN2016/072298.

* cited by examiner

ARC-SHAPED PLATE HEAT EXCHANGER

BACKGROUND

Technical Field

The present invention relates to the field of heat-exchanging device technologies, and specifically, to an arc-shaped plate heat exchanger having a compact structure, a small pressure drop, and high heat transfer efficiency.

Related Art

A heat exchanger is a device for exchanging heat between two fluids, mainly by conduction, radiation, and convection, or a combination thereof. A plate heat exchanger is an efficient compact heat-exchanging device, and has various advantages such as high heat transfer coefficient and compact structure. With the structural improvement and development of technologies for manufacturing large-sized heat exchangers, plate heat exchangers are attracting more attention. Conventional plate heat exchangers mainly include spiral plate heat exchangers and plate heat exchangers. The spiral plate heat exchanger is disadvantageous mainly in that its single passage restricts the cross-sectional area of the passage, limiting its use to low-flow-rate occasions, for example, air-air heat exchange. The plate heat exchanger is disadvantageous mainly in low pressure-bearing capability and high pressure drop, and therefore is not applicable to high-throughput heat exchange.

SUMMARY

To resolve the disadvantages of the foregoing technologies, the present invention provides an arc-shaped plate heat exchanger, which has such advantages as compact structure, high heat transfer efficiency, and wide application range.

To resolve the disadvantages of the foregoing technologies, technical solutions used in the present invention are: an arc-shaped plate heat exchanger, including a cylindrical housing and a heat-exchanging plate assembly disposed in the housing, where the housing is provided with an inlet and an outlet that are in communication with a fluid passage in the heat-exchanging plate assembly. The housing is generally a cylindrical housing. Two ends in a length direction of the housing are respectively provided with a first fluid inlet and a first fluid outlet. A side wall of the housing is provided with a second fluid inlet and a second fluid outlet. The heat-exchanging plate assembly includes two groups of arc-shaped heat-exchanging plates symmetrically disposed on two sides of an axis of the housing. The radian of the arc-shaped heat-exchanging plate is less than 180°. Each group of arc-shaped heat-exchanging plates includes multiple arc-shaped heat-exchanging plates whose sizes gradually increase from inside to outside starting from the center of the housing to form a first fluid passage and a second fluid passage that are spaced away from each other.

Two end surfaces of the first fluid passage parallel to the axis of the housing are sealed. Two end surfaces of the first fluid passage perpendicular to the axis of the housing, are separately provided with passage openings, to form a straight passage along the axis of the housing. A hot fluid (a cold fluid) enters the straight passage from the first fluid inlet of the housing, then flows along the axis of the housing, and flows out from the first fluid outlet.

Two end surfaces of the second fluid passage perpendicular to the axis of the housing are sealed. Two end surfaces of the second fluid passage parallel to the axis of the housing are separately provided with passage openings, to form an arc-shaped passage along a circumference direction. A cold fluid (a hot fluid) enters the arc-shaped passage from the second fluid inlet of the housing, then flows along the arc-shaped passage, and flows out from the second fluid outlet.

An area between the two groups of arc-shaped heat-exchanging plates is separated by a separator into an inlet collection chamber and an outlet collection chamber that are respectively in communication with a corresponding inlet and a corresponding outlet of the housing. Inlet ends of multiple second fluid passages of the heat-exchanging plate assembly gather in the inlet collection chamber, and outlet ends of the multiple second fluid passages gather in the outlet collection chamber. A second fluid first enters the inlet collection chamber from the inlet of the housing, and then separately enters the second fluid passages through the inlet collection chamber. The fluid flowing out through the second fluid passages gathers in the outlet collection chamber, and flows out from the outlet of the housing. Two ends of the inlet collection chamber and the outlet collection chamber are sealed by using an end baffle in a direction parallel to the axis of the housing, to prevent a first fluid from entering the inlet collection chamber and the outlet collection chamber.

As a further improvement to the arc-shaped plate heat exchanger of the present invention, two side baffles extending along the axis of the housing are respectively housing disposed between the housing and two outmost arc-shaped heat-exchanging plates, a gap between the housing and the heat-exchanging plate assembly is divided by the two side baffles into two cavities respectively in communication with the inlet collection chamber and the outlet collection chamber.

As a further improvement to the arc-shaped plate heat exchanger of the present invention, the heat-exchanging plate assembly further includes two reinforcing rings, and the two reinforcing rings are respectively sleeved on two ends of outmost arc-shaped heat-exchanging plates. The reinforcing rings are fixedly welded to the arc-shaped heat-exchanging plates and the end baffle. The reinforcing rings may make the first fluid passage effectively connected to the second fluid passage of the heat-exchanging plate assembly.

As a further improvement to the arc-shaped plate heat exchanger of the present invention, the reinforcing rings are connected to an inner wall of the housing by using arc-shaped connection plates. The arc-shaped connection plates are annular metal plates, are separately fixedly welded to the inner wall of the housing and the reinforcing rings, and can effectively ease a temperature difference stress.

As a further improvement to the arc-shaped plate heat exchanger of the present invention, the separator is a separation plate, the separation plate is disposed in an area between the two groups of arc-shaped heat-exchanging plates along the axis of the housing, and the separation plate is separately hermetically connected to two inmost arc-shaped heat-exchanging plates.

As a further improvement to the arc-shaped plate heat exchanger of the present invention, the separator is a central pipe, two ends of the central pipe are respectively in communication with an inlet and an outlet of the housing that correspond to the straight passage, and the central pipe is provided with a butterfly valve. The central pipe is used a means of adjustment. When the temperature on the outlet side needs to be increased, the central pipe is opened by using the butterfly valve, so that a part of fluid is directly mixed into the fluid on the outlet side from the central pipe to increase the temperature. The temperature may be adjusted by means of an open degree of the butterfly valve.

As a further improvement to the arc-shaped plate heat exchanger of the present invention, the separator is a spiral plate heat exchanger, the spiral plate heat exchanger has an axial passage and a spiral passage, an inlet and an outlet of the axial passage are respectively in communication with an inlet and an outlet of the straight passage in the housing, and an inlet and an outlet of the spiral passage are respectively in communication with an inlet and an outlet of the arc-shaped passage in the housing.

As a further improvement to the arc-shaped plate heat exchanger of the present invention, two end surfaces of the first fluid passage parallel to the axis of the housing are sealed by using lateral sealing strips, or are sealed by a flange of any one of the arc-shaped heat-exchanging plates that form the fluid passage.

As a further improvement to the arc-shaped plate heat exchanger of the present invention, two end surfaces of the second fluid passage perpendicular to the axis of the housing are sealed by using end sealing strips, or are sealed by a flange of any one of the arc-shaped heat-exchanging plates that form the fluid passage.

As a further improvement to the arc-shaped plate heat exchanger of the present invention, supporting members are dispersedly disposed in the first fluid passages and the second fluid passages. The supporting members are configured to maintain spacings of the first fluid passages and the second fluid passages, and may improve a pressure-bearing capability of the entire device.

As a further improvement to the arc-shaped plate heat exchanger of the present invention, the supporting members are metal columns or metal strips. Metal columns are preferred. The metal columns are fixedly disposed inside the fluid passage.

As a further improvement to the arc-shaped plate heat exchanger of the present invention, the supporting members are protrusions formed on surfaces of arc-shaped heat-exchanging plates. "Dimple"-shaped protrusions formed due to plate stamping are preferred.

There is a pressure difference between an inlet end and an outlet end of the second fluid passage. A longer passage length indicates a larger pressure drop. Pressures on inlet sides of all passages are equal. Therefore, pressures on outlet sides of all the passages need to be basically the same if evenness of fluid distribution in the second fluid passage needs to be ensured. To achieve this objective, the following method may be used:

Spacings between the multiple second fluid passages formed in the heat-exchanging plate assembly gradually increase from inside to outside; or spacings between the multiple second fluid passages of the heat-exchanging plate assembly maintain consistent, and the density of supporting members in the multiple second fluid passages gradually decreases from inside to outside; or spacings between the multiple second fluid passages of the heat-exchanging plate assembly gradually increases from inside to outside, and the density of the supporting members in the passages gradually decreases from inside to outside; or the heat-exchanging plate assembly is further provided with baffle plates, and the baffle plates are disposed inside the inlet collection chamber and the outlet collection chamber, and connect end openings of two neighboring second fluid passages together, so that the multiple second fluid passages form a serial connection structure. In this manner, second fluid passages close to the inside and having relatively short flow paths are connected in series to form a passage having a relatively long flow path.

During heat exchange, a cold fluid (or a hot fluid) enters a heat exchanger from a first fluid inlet of a housing, flows through a straight passage of arc-shaped heat-exchanging plates, and flows out from a first fluid outlet. A hot fluid (or a cold fluid) enters the heat exchanger from a second fluid inlet on a side wall of the housing, flows through an arc-shaped passage of arc-shaped heat-exchanging plates, and flows out from a second fluid outlet, thereby completing heat exchange between the cold fluid and the hot fluid.

Beneficial Effects

1. Arc-shaped heat-exchanging plates are used in the heat exchanger in the present invention. Therefore, the structure of the heat exchanger is compact, a heat-exchanging area per unit volume is 1.6 to 2 times larger than that of a tube heat exchanger, and a pressure-bearing capability is stronger than that of a plate heat exchanger.

2. Arc-shaped heat-exchanging plates are used in the heat exchanger in the present invention. Therefore, affected by fluid interference of supporting columns and the centrifugal force that is generated by the arc-shaped heat-exchanging plates on the fluids, the heat transfer coefficient of the heat exchanger is 1.5 to 1.8 times greater than a tube heat exchanger under a condition of a same flowing speed.

3. The pressure drop of the heat exchanger in the present invention is small, and the flowing drag of the fluids is small. Therefore, power consumption of a pump or a fan can be reduced. The heat exchanger is applicable to high-throughput heat exchange, and operating costs are low.

BRIEF DESCRIPTION OF THE DRAWINGS

The disclosure will become more fully understood from the detailed description given herein below for illustration only, and thus are not limitative of the disclosure, and where.

Figure 1:
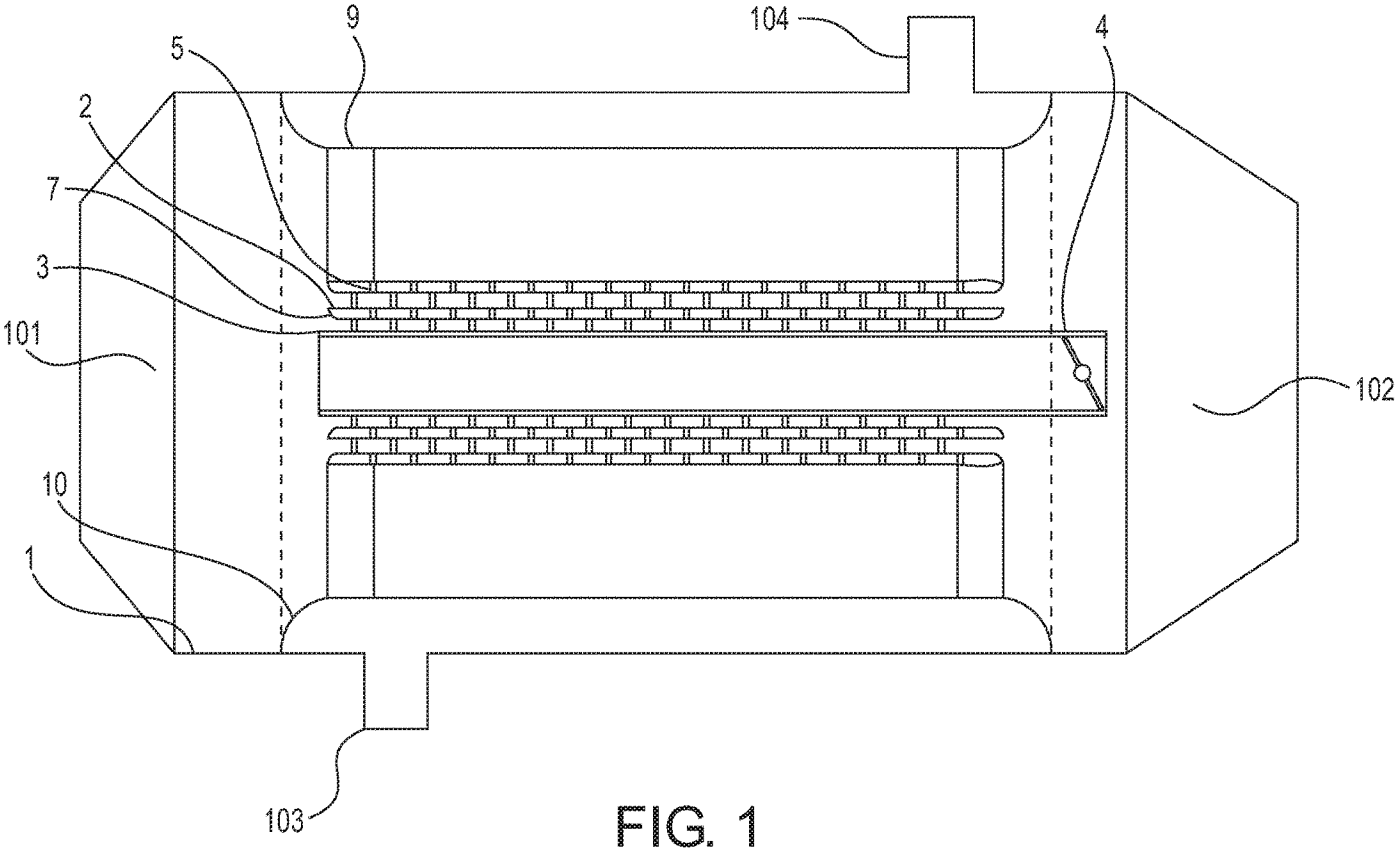
FIG. 1 is a schematic inner structural diagram of a heat exchanger according to the present invention.

In the figures: 1. Housing, 101. First fluid inlet, 102. First fluid outlet, 103. Second fluid inlet, 104. Second fluid outlet, 2. Arc-shaped heat-exchanging plate, 201. First fluid passage, 202. Second fluid passage, 203. Side baffles, 204. Inlet collection chamber, 205. Outlet collection chamber, 206. End baffle, 3. Central pipe, 4. Butterfly valve, 5. Supporting member, 6. Lateral sealing strip, 7. End sealing strip, 8. Baffle plate, 9. Reinforcing rings, 10. Arc-shaped connection plate, 11. Separation plate, 12. Spiral plate heat exchanger

DETAILED DESCRIPTION

As shown in FIG. 1 to FIG. 6, an arc-shaped plate heat exchanger includes a cylindrical housing 1 and a heat-exchanging plate assembly disposed in the housing 1, the housing 1 being provided with an inlet and an outlet that are in communication with a fluid passage in the heat-exchanging plate assembly. The housing 1 is generally a cylindrical housing 1. Two ends in a length direction of the housing 1 are respectively provided with a first fluid inlet 101 and a first fluid outlet 102. A side wall of the housing 1 is provided with a second fluid inlet 103 and a second fluid outlet 104. The heat-exchanging plate assembly includes two groups of arc-shaped heat-exchanging plates 2 symmetrically disposed on two sides of an axis of the housing 1. The radian of the arc-shaped heat-exchanging plate 2 is less than 180°. Each group of arc-shaped heat-exchanging plates 2 includes multiple arc-shaped heat-exchanging plates 2 whose sizes gradually increase from inside to outside starting from the center of the housing 1 to form a first fluid passage 201 and a second fluid passage 202 that are spaced away from each other.

As shown in FIG. 2 to FIG. 6, two end surfaces of the first fluid passage 201 parallel to the axis of the housing 1 are sealed. Two end surfaces of the first fluid passage 201 perpendicular to the axis of the housing 1 are separately provided with passage openings to form a straight passage along the axis of the housing 1. A hot fluid (a cold fluid) enters the straight passage from the first fluid inlet of the housing 1, then flows along the direction of the axis of the housing 1, and flows out from the first fluid outlet. Two end surfaces of the second fluid passage 202 perpendicular to the axis of the housing 1 are sealed. Two end surfaces of the second fluid passage 202 parallel to the axis of the housing 1 are separately provided with passage openings to form an arc-shaped passage in a circumference direction. A cold fluid (a hot fluid) enters the arc-shaped passage from the second fluid inlet of the housing 1, then flows along the arc-shaped passage, and flows out from the second fluid outlet.

Figure 2:
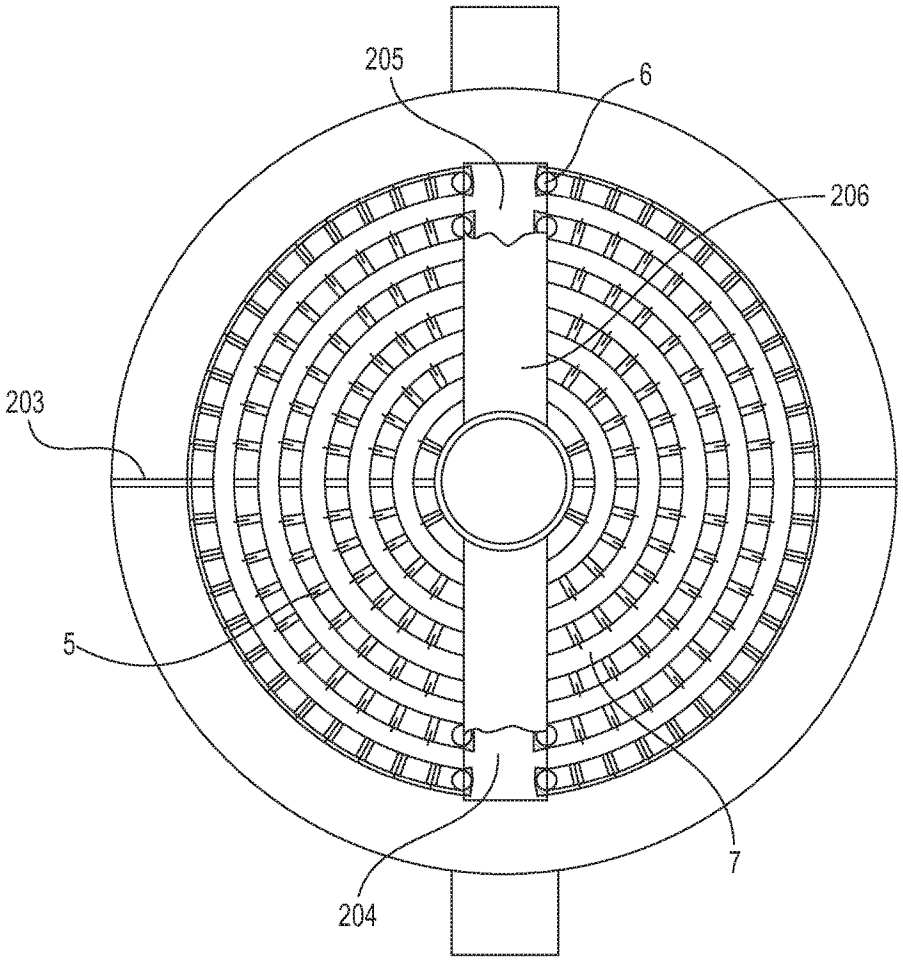
FIG. 2 is a schematic structural diagram of a heat-exchanging plate assembly of a heat exchanger disposed in a housing according to the present invention.
Figure 3:
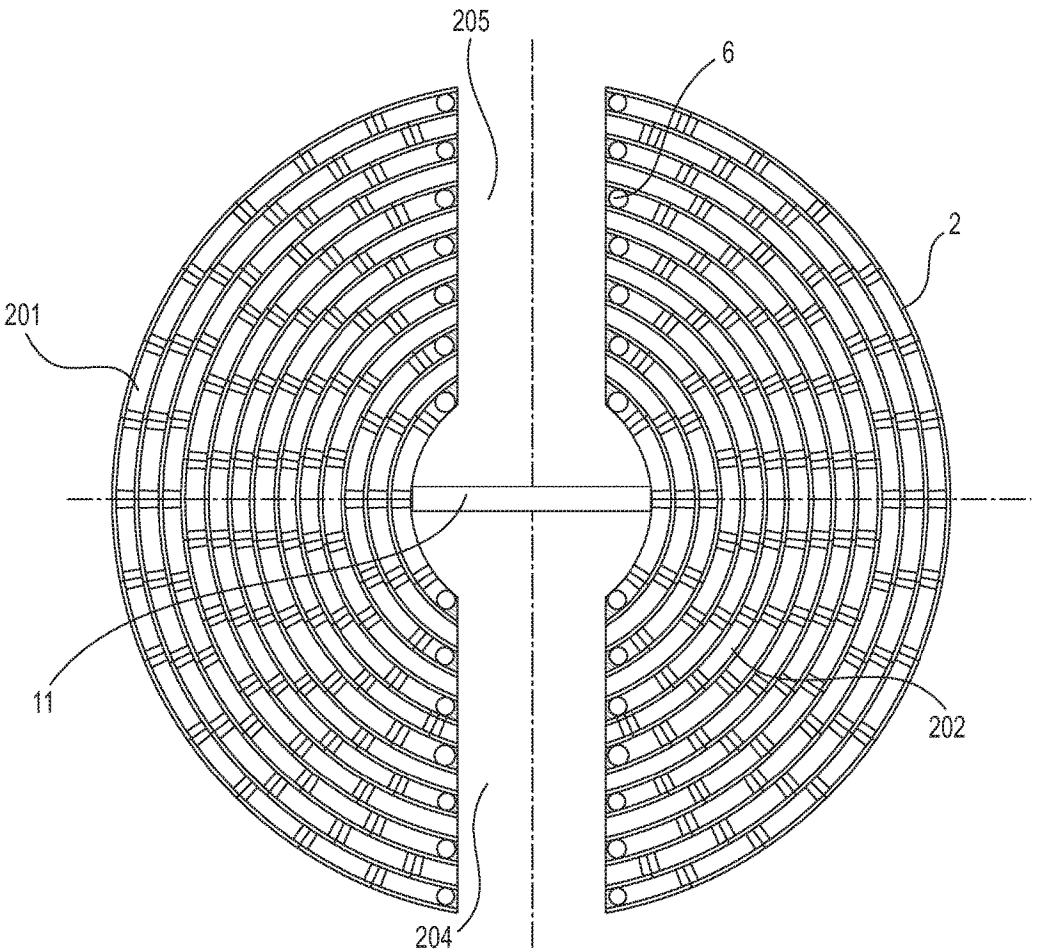
FIG. 3 is a schematic structural diagram of a heat-exchanging plate assembly (which has a separation plate) of a heat exchanger according to the present invention.

As shown in FIG. 2 and FIG. 3, an area between the two groups of arc-shaped heat-exchanging plates 2 is separated by a separator into an inlet collection chamber 204 and an outlet collection chamber 205 that are respectively in communication with a corresponding inlet and a corresponding outlet of the housing 1. Inlet ends of multiple second fluid passages 202 of the heat-exchanging plate assembly gather in the inlet collection chamber 204, and outlet ends of the multiple second fluid passages gather in the outlet collection chamber 205. A second fluid first enters the inlet collection chamber 204 from the inlet of the housing 1, and then separately enters the second fluid passages through the inlet collection chamber 204. The fluid flowing out through the second fluid passages gathers in the outlet collection chamber 205, and flows out from the outlet of the housing 1. Two ends of the inlet collection chamber 204 and the outlet collection chamber 205 are sealed by using an end baffle 206 in a direction parallel to the axis of the housing 1, to prevent a first fluid from entering the inlet collection chamber 204 and the outlet collection chamber 205.

As shown in FIG. 2, two side baffles 203 extending along the axis of the housing 1 are respectively provided between the housing 1 and two outermost arc-shaped heat-exchanging plates 2, and a gap between the housing 1 and the heat-exchanging plate assembly is divided by the two side baffles 203 into two cavities respectively in communication with the inlet collection chamber 204 and the outlet collection chamber 205.

As shown in FIG. 1, the heat-exchanging plate assembly further includes two reinforcing rings 9, and the two reinforcing rings 9 are respectively sleeved on two ends of outmost arc-shaped heat-exchanging plates 2. The reinforcing rings 9 are fixedly welded to the arc-shaped heat-exchanging plates 2 and the end baffles. The reinforcing rings 9 may make the first fluid passages 201 effectively connected to the second fluid passages 202 of the heat-exchanging plate assembly. Arc-shaped connection plates 10 are disposed between the reinforcing rings 9 and an inner wall of the housing 1. The arc-shaped connection plates 10 are annular metal plates, are separately fixedly welded to the inner wall of the housing 1 and the reinforcing rings 9, and can effectively ease a temperature difference stress.

As shown in FIG. 3, the separator is a separation plate 11, the separation plate 11 is disposed in an area between the two groups of arc-shaped heat-exchanging plates 2 along the axis of the housing 1, and the separation plate 11 is separately hermetically connected to two inmost arc-shaped heat-exchanging plates 2.

Figure 4:
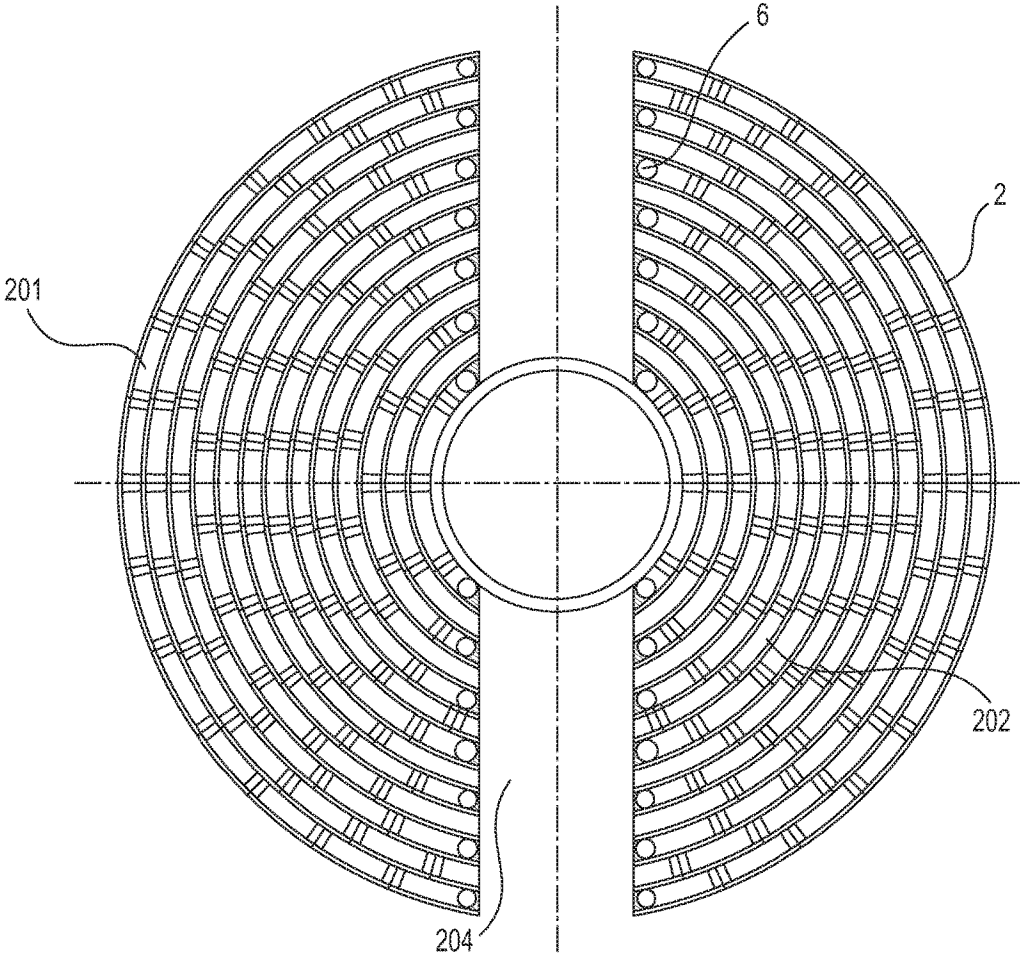
FIG. 4 is a schematic structural diagram of a heat-exchanging plate assembly (which has a central pipe) of a heat exchanger according to the present invention.

As shown in FIG. 4, the separator is a central pipe 3, two ends of the central pipe 3 are respectively in communication with an inlet and an outlet on the housing 1 that correspond to the straight passage, and the central pipe 3 is provided with a butterfly valve 4. As an adjustment means, when the temperature on the outlet side needs to be increased, the central pipe 3 is opened by using the butterfly valve 4, so that a part of fluid is directly mixed into the fluid on the outlet side from the central pipe 3 to increase the temperature. The temperature may be adjusted by means of an open degree of the butterfly valve 4.

Figure 5:
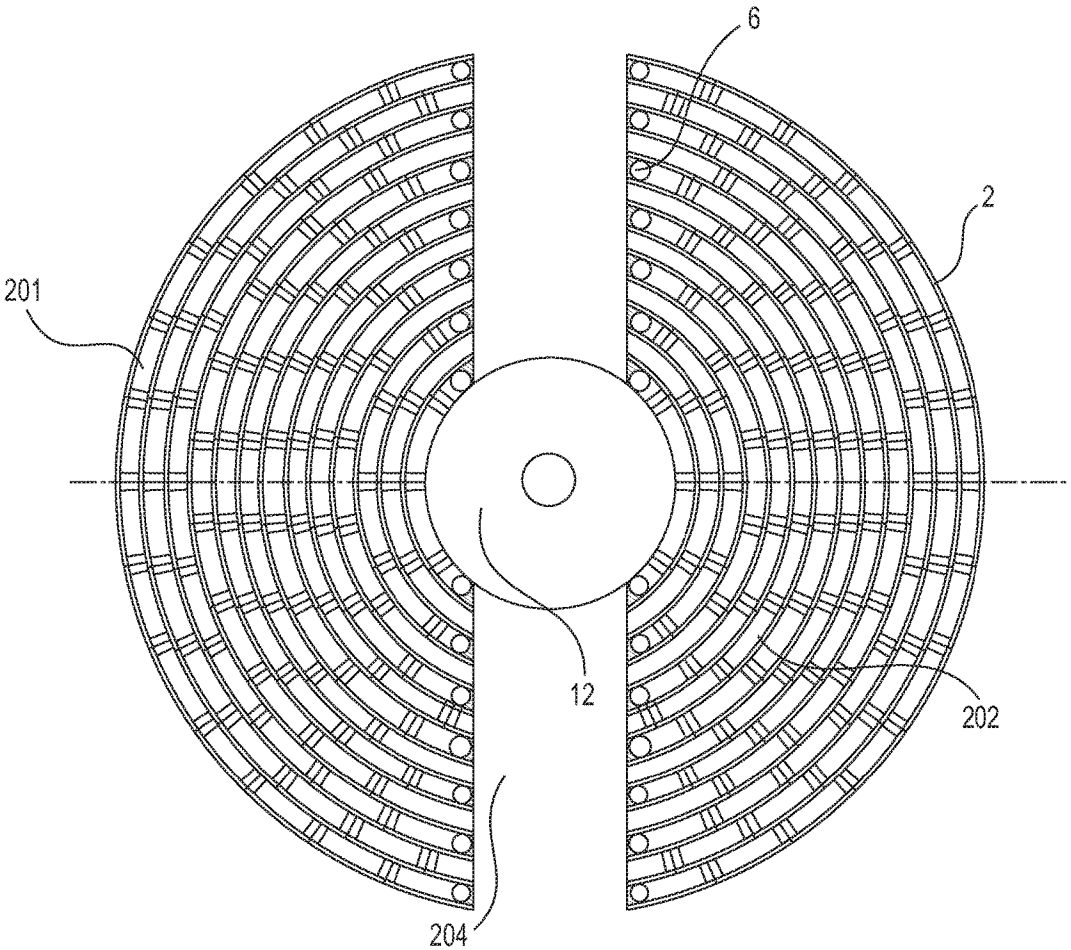
FIG. 5 is a schematic structural diagram of a heat-exchanging plate assembly (which has a spiral plate heat exchanger) of a heat exchanger according to the present invention.
Figure 6:
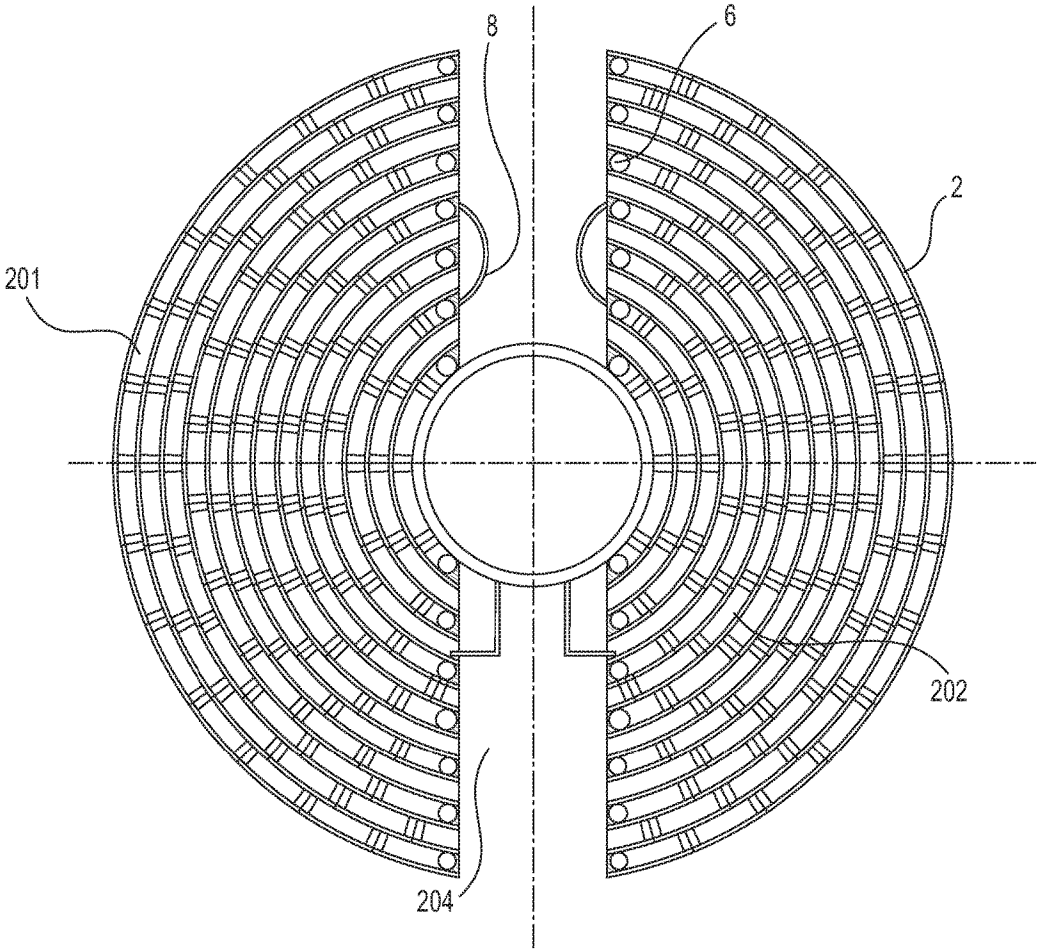
FIG. 6 is a schematic structural diagram of a heat-exchanging plate assembly (which has a central pipe and baffle plates) of a heat exchanger according to the present invention.

As shown in FIG. 5, the separator is a spiral plate heat exchanger 12, the spiral plate heat exchanger 12 has an axial passage and a spiral passage, an inlet and an outlet of the axial passage are respectively in communication with an inlet and an outlet of the straight passage in the housing 1, and an inlet and an outlet of the spiral passage are respectively in communication with an inlet and an outlet of the arc-shaped passage in the housing 1.

Two end surfaces of the first fluid passage 201 parallel to the axis of the housing 1 are sealed by using lateral sealing strips 6, or are sealed by a flange of any one of the arc-shaped heat-exchanging plates 2 that form the fluid passage.

Two end surfaces of the second fluid passage 202 perpendicular to the axis of the housing 1 are sealed by using end sealing strips 7, or are sealed by a flange of any one of the arc-shaped heat-exchanging plates 2 that form the fluid passage.

Figure 7:
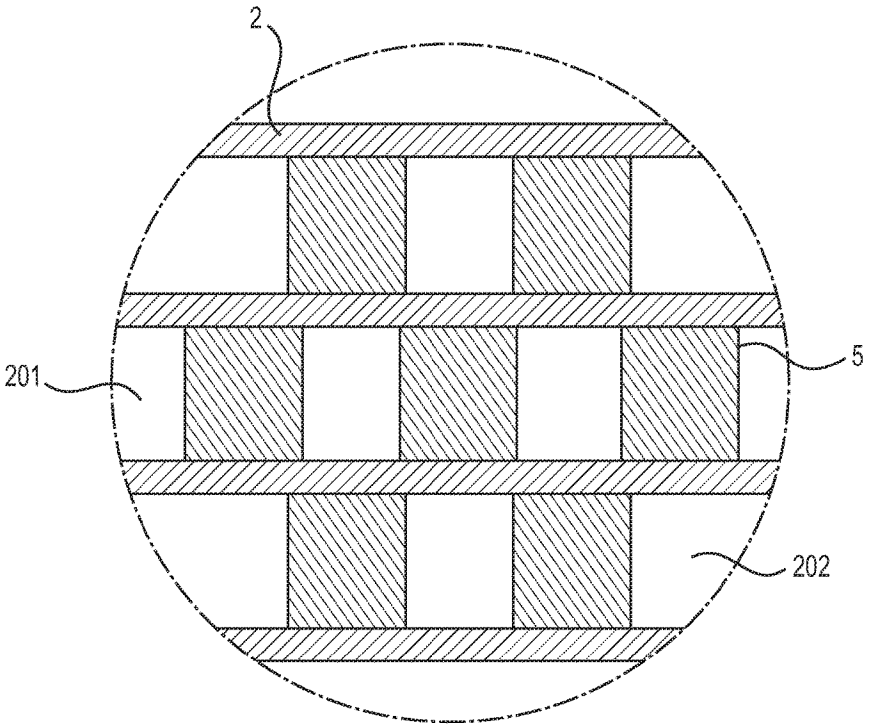
FIG. 7 is a schematic diagram of an inside structure of fluid passages (supporting members are metal strips) of a heat exchanger according to the present invention.
Figure 8:
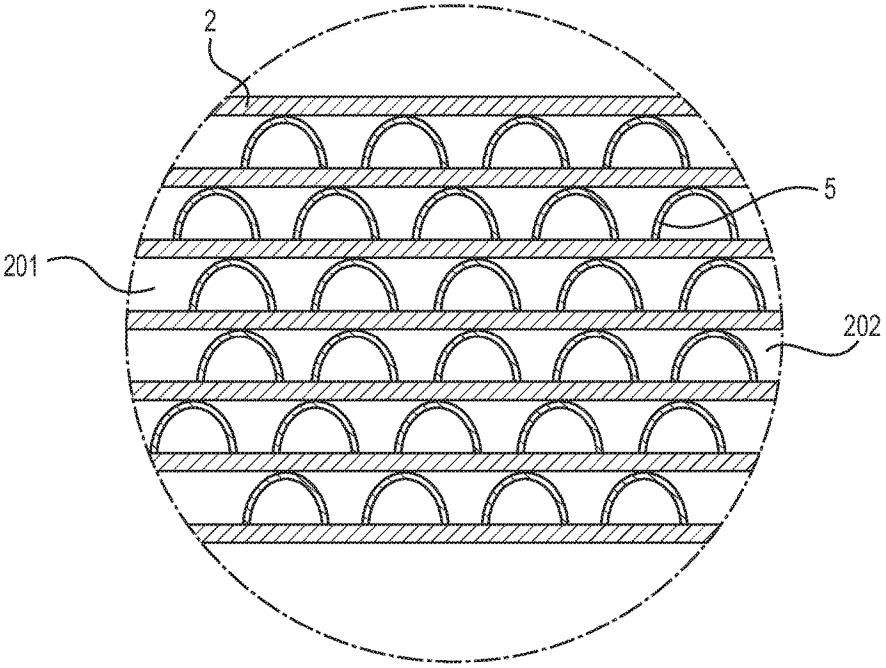
FIG. 8 is a schematic diagram of an inside structure of fluid passages (supporting members are protrusions on surfaces) of a heat exchanger according to the present invention.

As shown in FIG. 7 and FIG. 8, supporting members 5 are dispersedly disposed in the first fluid passage 201 and the second fluid passage 202. The supporting members 5 are configured to maintain spacings of the fluid □ passages and the fluid □ passages, and can improve the pressure-bearing capability of an entire device.

The supporting members 5 are metal columns, and the metal columns are fixedly disposed inside the fluid passage.

The supporting members 5 are protrusions formed on surfaces of any one of the arc-shaped heat-exchanging plates 2.

Figure 9:
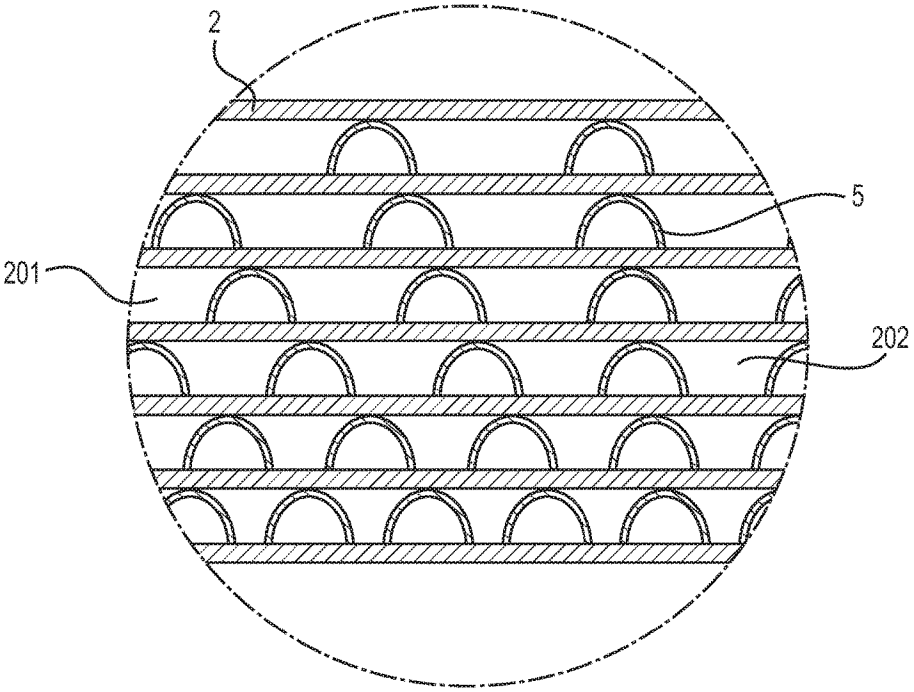
FIG. 9 is a schematic diagram of an inside structure of fluid passages (supporting members are protrusions on surfaces) of a heat exchanger according to an embodiment.
Figure 10:
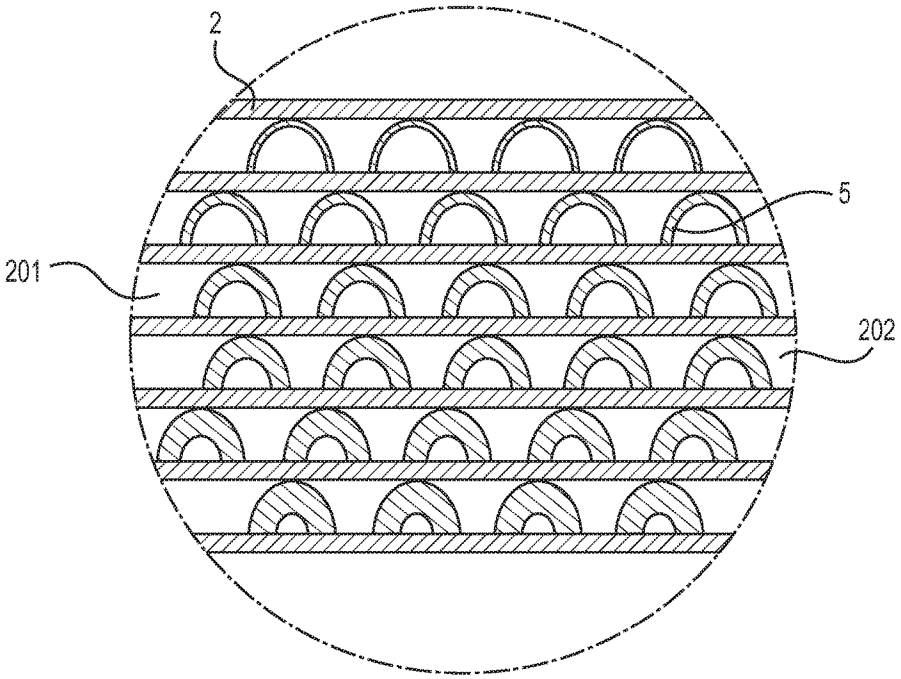
FIG. 10 is a schematic diagram of an inside structure of fluid passages (supporting members are protrusions on surfaces) of a heat exchanger according to an embodiment.

There is a pressure difference between an inlet end and an outlet end of the fluid □ passage. A longer passage length indicates a larger pressure drop. Pressures on inlet sides of all passages are equal. Therefore, pressures on outlet sides of all the passages need to be basically the same if evenness of fluid distribution in the fluid II passage needs to be ensured. To achieve this objective, the following method may be used:

the density of supporting members 5 in multiple second fluid passages 202 maintains consistent, and spacings between the fluid passages gradually increase from inside to outside, as depicted in FIG. 9; or spacings between multiple second fluid passages 202 of the heat-exchanging plate assembly maintain consistent, and the density of supporting members 5 in the fluid passages gradually decreases from inside to outside, as depicted in FIG. 10; or multiple second fluid passages 202 of the heat-exchanging plate assembly gradually increase from inside to outside, and the density of supporting members 5 in the passages gradually decreases from inside to outside; or the heat-exchanging plate assembly is further provided with baffle plates 8, the baffle plates 8 are disposed in the inlet collection chamber 204 and the outlet collection chamber 205 to connect second fluid passages 202 close to the inside and having relatively short flow paths in series to form a passage having a relatively long flow path.

During heat exchange, a cold fluid (or a hot fluid) enters a heat exchanger from a first fluid inlet of a housing 1, flows through a straight passage of arc-shaped heat-exchanging plates 2, and flows out from a first fluid outlet. A hot fluid (or a cold fluid) enters the heat exchanger from a second fluid inlet on a side wall of the housing 1, flows through an arc-shaped passage of arc-shaped heat-exchanging plates 2, and flows out from a second fluid outlet, thereby completing heat exchange between the cold fluid and the hot fluid.

Descriptions above are merely preferred embodiments of the present invention, and are not intended to limit the present invention. Although the present invention has been disclosed above by using the preferred embodiments, the embodiments are not intended to limit the present invention. A person skilled in the art can make some equivalent variations, alterations or modifications to the above-disclosed technical content without departing from the scope of the technical solutions of the present invention to obtain equivalent embodiments. Any simple alteration, equivalent change or modification made to the above embodiments according to the technical essence of the present invention without departing from the content of the technical solutions of the present invention shall fall within the scope of the technical solutions of the present invention.

What is claimed is:

1. An arc-shaped plate heat exchanger, comprising:

a cylindrical housing; and a heat-exchanging plate assembly disposed in the housing, the housing being provided with an inlet and an outlet that are in communication with a fluid passage in the heat-exchanging plate assembly, the heat-exchanging plate assembly including:

two groups of arc-shaped heat-exchanging plates symmetrically disposed on two sides of an axis of the housing, each group of arc-shaped heat-exchanging plates includes multiple arc-shaped heat-exchanging plates having sizes that gradually increase from a center of the housing outward, to form a first fluid passage and a second fluid passage that are spaced away from each other;

two end surfaces of the first fluid passage parallel to the axis of the housing are sealed, and passage openings are provided on the two end surfaces of the first fluid passage perpendicular to the axis of the housing forming a straight passage along the axis of the housing;

two end surfaces of the second fluid passage perpendicular to the axis of the housing are sealed, and passage openings are provided on the two end surfaces of the second fluid passage parallel to the axis of the housing forming an arc-shaped passage along a circumferential direction;

an area between the two groups of arc-shaped heat-exchanging plates is separated into an inlet collection chamber and an outlet collection chamber by a separator, inlet ends of the second fluid passages of the heat-exchanging plate assembly being located in the inlet collection chamber, outlet ends of the second fluid passages being located in the outlet collection chamber, and the inlet ends and outlet ends of neighboring second fluid passages are connected so as to form a serial connection structure;

baffle plates disposed inside the inlet collection chamber and the outlet collection chamber;

an end of the inlet collection chamber and an end of the outlet collection chamber are both sealed with an end baffle; and two reinforcing rings respectively sleeved on two ends of outermost arc-shaped heat-exchanging plates of the multiple arc-shaped heat-exchanging plates.

2. The arc-shaped plate heat exchanger according to claim 1, wherein two side baffles extending along the axis of the housing are respectively disposed between the housing and the two outermost arc-shaped heat-exchanging plates of the two groups of arc-shaped heat-exchanging plates, and a gap between the housing and the heat-exchanging plate assembly is divided by the two side baffles into two cavities respectively in communication with the inlet collection chamber and the outlet collection chamber.

3. The arc-shaped plate heat exchanger according to claim 1, wherein the reinforcing rings are connected to an inner wall of the housing by using arc-shaped connection plates.

4. The arc-shaped plate heat exchanger according to claim 1, wherein the separator is a separation plate disposed in an area between the two groups of arc-shaped heat-exchanging plates along the axis of the housing, the separation plate being separately hermetically connected to two innermost arc-shaped heat-exchanging plates of the heat-exchanging plate assembly.

5. The arc-shaped plate heat exchanger according to claim 1, wherein the separator is a central pipe, two ends of the central pipe are respectively in communication with the inlet and the outlet on the housing corresponding to the straight passage, and the central pipe including a butterfly valve.

6. The arc-shaped plate heat exchanger according to claim 1, wherein the separator is a spiral plate heat exchanger having an axial passage and a spiral passage, an inlet and an outlet of the axial passage being in respective communication with an inlet and an outlet of the straight passage in the housing, and an inlet and an outlet of the spiral passage are in respective communication with an inlet and an outlet of the arc-shaped passage in the housing.

7. The arc-shaped plate heat exchanger according to claim 1, wherein the two end surfaces of each of the first fluid passages parallel to the axis of the housing are sealed by either one of (i) lateral sealing strips or (ii) a flange of any of the arc-shaped heat-exchanging plates that form the fluid passage.

8. The arc-shaped plate heat exchanger according to claim 1, wherein the two end surfaces of each of the second fluid passages perpendicular to the axis of the housing are sealed by either one of (i) end sealing strips or (ii) a flange of any of the arc-shaped heat-exchanging plates that form the fluid passage.

9. The arc-shaped plate heat exchanger according to claim 1, wherein supporting members are dispersedly disposed in the first fluid passages and the second fluid passages.

10. The arc-shaped plate heat exchanger according to claim 9, wherein the supporting members are metal columns or protrusions formed on a surface of arc-shaped heat-exchanging plates.

11. The arc-shaped plate heat exchanger according to claim 9, wherein multiple spacings between the second fluid passages are formed in the heat-exchanging plate assembly, the multiple spacings gradually increasing radially outward.

12. The arc-shaped plate heat exchanger according to claim 9, wherein a density of the supporting members in the second fluid passages of the heat-exchanging plate assembly gradually decreases radially outward.

* * * * *